US006935865B2

(12) United States Patent
Sasaki

(10) Patent No.: US 6,935,865 B2
(45) Date of Patent: Aug. 30, 2005

(54) CYLINDRICAL ELECTRIC CONNECTION APPARATUS WITH ALTERNATE LAMINATION OF DIELECTRIC LAYER AND CONDUCTOR LAYER, WIRING MEMBER USED FOR THE APPARATUS, AND METHOD OF MANUFACTURING THE WIRING MEMBER

(75) Inventor: Kazuyoshi Sasaki, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 120 days.

(21) Appl. No.: 10/461,444

(22) Filed: Jun. 16, 2003

(65) Prior Publication Data

US 2004/0002242 A1 Jan. 1, 2004

(30) Foreign Application Priority Data

Jun. 27, 2002 (JP) ..... 2002-188443

(51) Int. Cl.[7] ..... H01R 39/40
(52) U.S. Cl. ..... 439/31; 439/660; 439/668
(58) Field of Search ..... 439/31, 660, 668, 439/675, 669, 345

(56) References Cited

U.S. PATENT DOCUMENTS 3,980,380 A * 9/1976 Cieniawa et al. ..... 439/404
4,590,540 A * 5/1986 Nicholson et al. ..... 361/682
6,010,369 A * 1/2000 Itabashi et al. ..... 439/660
6,398,586 B1 * 6/2002 Muzslay ..... 439/606

FOREIGN PATENT DOCUMENTS

| | | |
|---|---|---|
| JP | 63-164115 | 10/1988 |
| JP | 63-291309 | 11/1988 |
| JP | 2000-048652 | 2/2000 |

* cited by examiner

*Primary Examiner*—J. F. Duverne
(74) *Attorney, Agent, or Firm*—Finnegan, Henderson, Farabow. Garrett & Dunner, L.L.P.

(57) ABSTRACT

An electric connection apparatus includes a cylindrical main body through which a center shaft passes. The main body has a plurality of conductor layers, and rigid dielectric layers which electrically insulate the conductor layers. The conductor layers and dielectric layers are alternately laminated in the radial direction of the center shaft. The main body has a first terminal to which the conductor layers are exposed, and a second terminal to which the conductor layers are exposed. The first and second terminals shift each other in the axial direction of the main body. A first connector is attached to the first terminal, and has a plurality of contact parts to contact the conductor layers. A second connector is attached to the second terminal, and has a plurality of contact parts to contact the conductor layers.

10 Claims, 5 Drawing Sheets

CYLINDRICAL ELECTRIC CONNECTION APPARATUS WITH ALTERNATE LAMINATION OF DIELECTRIC LAYER AND CONDUCTOR LAYER, WIRING MEMBER USED FOR THE APPARATUS, AND METHOD OF MANUFACTURING THE WIRING MEMBER

CROSS-REFERENCE TO RELATED APPLICATIONS

This application is based upon and claims the benefit of priority from the prior Japanese Patent Application No. 2002-188443, filed Jun. 27, 2002, the entire contents of which are incorporated herein by reference.

BACKGROUND OF THE INVENTION

1. Field of the Invention

The present invention relates to an electric connection apparatus which electrically connects two units which are relatively rotatable. More particularly, the invention is concerned with a rigid cylindrical wiring member with alternate lamination of dielectric layer and conductor layer, and a method of manufacturing the wiring member.

2. Description of the Related Art

An electronic apparatus such as a portable computer comprises a main unit having a printed circuit board, and a display unit having a liquid crystal display unit. The display unit is connected to the rear end of the main unit through a hinge. With this structure, the display unit is rotatable between the closed position to lie over the main unit, and the opened position to rise against the main unit.

In a conventional portable computer, the printed circuit board is electrically connected to the liquid crystal display unit through a lead wire. The lead wire is a bundle of multiple electric wires, and has flexibility. The lead wire is routed over the main unit and display unit through the hinge.

With the above-mentioned structure, the lead wire passes through the hinge which connects the main unit and display unit. The hinge rotates following the display unit when turning up and down the display unit between the closed position and opened position. Thus, each time the display unit is turned up, it is unavoidable that the lead wire is repeatedly bent or twisted. Particularly, in a portable computer, the display unit is frequently turned up, and a large stress is applied to the intermediate part of the lead wire routed over the main unit and the display unit. This stress affects the durability of the lead wire, and may break the wire.

BRIEF SUMMARY OF THE INVENTION

According to an embodiment of the present invention, there is provided an electric connection apparatus comprising a center shaft; a cylindrical main body through which the center shaft passes; the main body having a plurality of conductor layers, and rigid dielectric layers which electrically insulate the conductor layers; the conductor layers and dielectric layers laminated alternately in the radial direction of the center shaft just like surrounding the center shaft; a first terminal which is formed in the main body, and to which the conductor layers are exposed; a second terminal which is formed in the main body, and to which the conductor layers are exposed; the second terminal located shifting in the axial direction of the main body with respect to the first terminal; a first connector which is attached to the first terminal of the main body; the first connector having a plurality of contact parts electrically connected to the conductor layers; and a second connector which is attached to the second terminal of the main body; the second connector having a plurality of contact parts electrically connected to the conductor layers.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

Hereinafter preferred embodiments of the present invention will be explained with reference to the accompanying drawings showing a portable computer to which the embodiments are applied.

Figure 1:
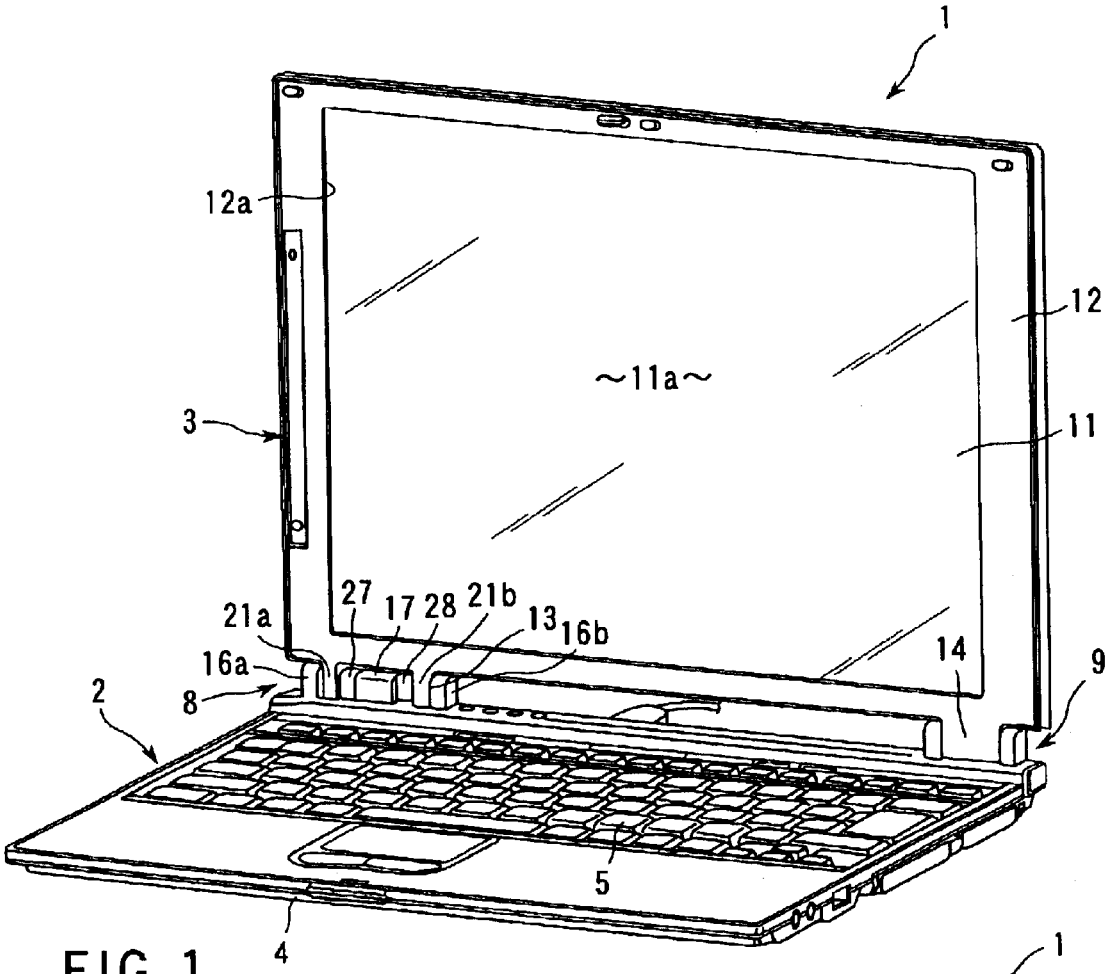
FIG. 1 is a perspective view of a portable computer according to an embodiment of the present invention, with a display unit turned up to the opened position.
Figure 2:
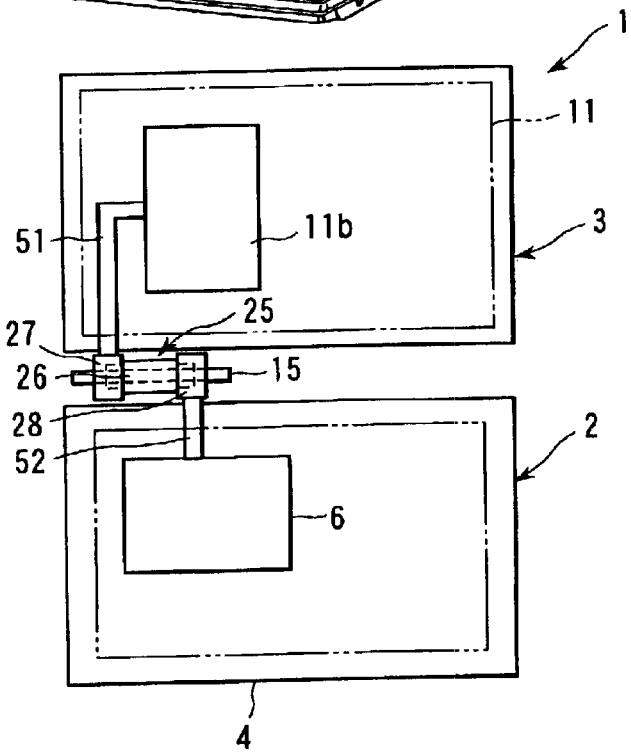
FIG. 2 is a schematic plan view of the portable computer according to the embodiment of the present invention, showing a main unit and the display unit connected electrically through an electrical connection apparatus.

FIG. 1 and FIG. 2 show a portable computer 1 as an electronic apparatus. The portable computer 1 has a main unit 2 and a display unit 3. The main unit 2 has a flat box-shaped housing 4. The housing 4 supports a keyboard 5, and contains a printed circuit board 6 as a first circuit module. The printed circuit board 6 is packaged with a CPU and other circuit components. First and second display supports 8 and 9 are formed at the rear end of the housing 4. The first and second display supports 8 and 9 are located at the rear of the keyboard 5, and separated from each other in the width direction of the housing 4. The display unit 3 has a liquid crystal display device 11 as a second unit, and a display housing 12 which contains the liquid crystal display device 11. The liquid crystal display device 11 has a screen 11*a* to display images, and a liquid crystal drive circuit 11*b*. The screen 11*a* is exposed to the outside of the display unit 3 through an opening 12*a* formed in the front of the display housing 12.

The display housing 12 has first and second feet 13 and 14. The first and second feet 13 and 14 are connected to the first and second display supports 8 and 9, respectively, through a hinge shaft 15 as a center shaft. With this structure, the display unit 3 is movable between the closed position and opened position. At the closed position, the display unit 3 lies over the housing 4 just like covering the keyboard 5. At the opened position, the display unit 3 rises against the housing 4 just like exposing the keyboard 5 and screen 11*a*.

Figure 3:
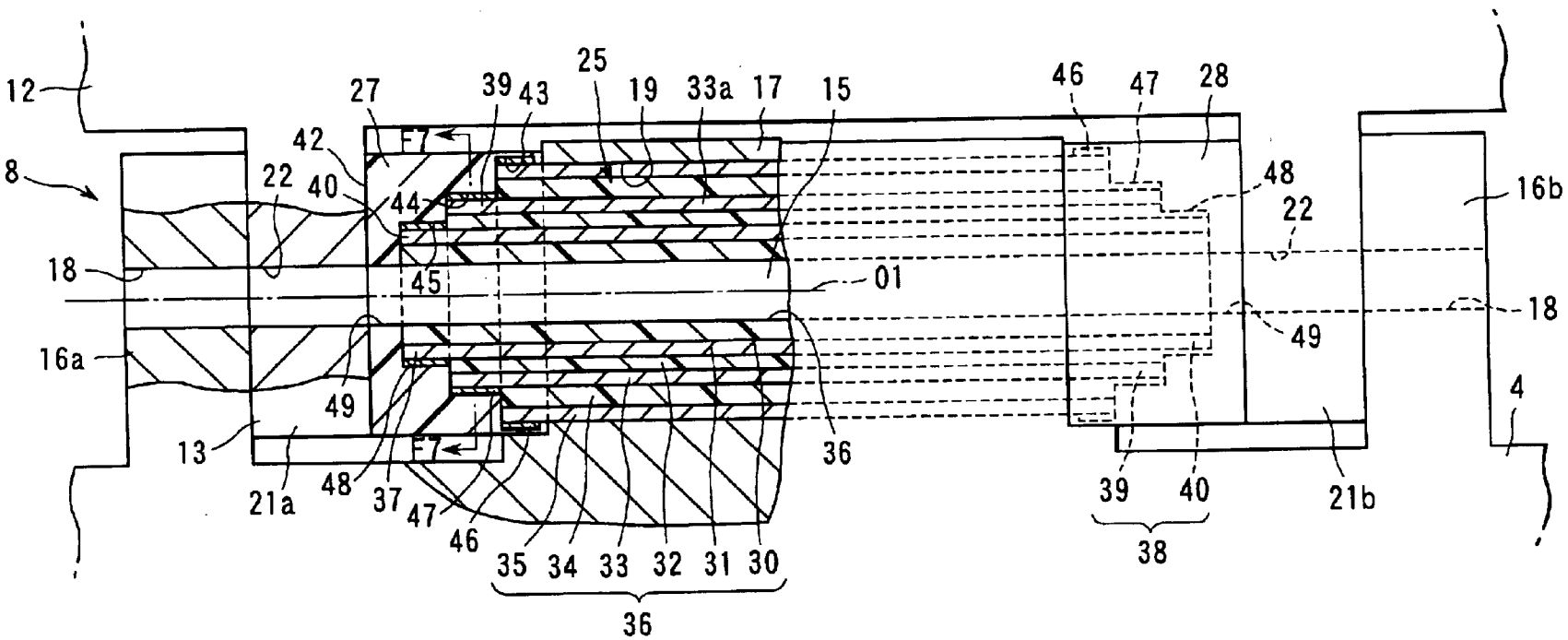
FIG. 3 is a sectional view of an electrical connection apparatus which electrically connects the main unit and the display unit, according to the embodiment of the present invention.

As shown in FIG. 1 and FIG. 3, the first display support 8 of the housing 4 has a pair of first bearings 16*a* and 16*b* and a hollow projection 17. The first bearing 16*a* and 16*b* project upward from the top surface of the housing 4, and are separated from each other in the width direction of the housing 4. The first bearings 16*a* and 16*b* each have a bearing hole 18. The projection 17 projects upward from the upper surface of the housing 4, and is located between the first bearings 16*a* and 16*b*. The projection 17 has a fitting hole 19 extending horizontally in the width direction of the housing 4. The fitting hole 19 and bearing hole 18 are coaxially aligned.

The first foot 13 of the display housing 12 has a pair of second bearings 21*a* and 21*b*. The second bearings 21*a* and 21*b* are separated from each other in the width direction of the display housing 12. One second bearing 21*a* is interposed between the first bearing 16*a* and the projection 17. The other second bearing 21*b* is interposed between the first bearing 16*b* and the projection 17. The second bearings 21*a* and 21*b* each have a through hole 22. The through hole 22 is located coaxial with the bearing hole 18.

The hinge shaft 15 is extended over horizontally between the first bearings 16*a* and 16*b*. One end and the other end of the hinge shaft 15 are fitted in the bearing hole 18 of the first bearings 16*a* and 16*b*, and rotatable in the circumferential direction. Further, the hinge shaft 15 passes through the through hole 22 of the second bearings 21*a* and 21*b* and the fitting hole 19 of the projection 17, and is fixed to the second bearings 21*a* and 21*b*. Thus, when the display unit 3 is turned up, the hinge shaft 15 follows the display unit 3 and rotates in the circumferential direction.

As shown in FIG. 2 and FIG. 3, an electric connection apparatus 25 according to the present invention is mounted on the hinge shaft 15. The electric connection apparatus 25 is used to make electrical connection between the printed circuit board 6 and the liquid crystal drive circuit 11*b* of the liquid crystal display device 11. The electric connection apparatus 25 comprises a cylindrical multi-layer printed wiring member 26 as a main unit, a first connector 27 and a second connector 28.

The wiring member 26 consists of alternately laminated multiple dielectric layers and conductive layers. In detail, the wiring member 26 comprises a first cylindrical dielectric layer 30, a power layer 31 laminated on the outer circumference of the first dielectric layer 30, a second dielectric layer 32 laminated just like covering the power layer 31, a signal layer 33 laminated on the outer circumference of the second dielectric layer 32, a third dielectric layer 34 laminated just like covering the signal layer 33, and a ground layer 35 laminated on the outer circumference of the third dielectric layer 34.

The first dielectric layer 30 is located at the center of the wiring member 26, and has a support hole 36 through which the hinge shaft 15 passes. The support hole 36 is located on the center axis 01 of the wiring member 26. The first to third dielectric layers 30, 32 and 34 are made of rigid synthetic resin material such as epoxy resin, and electrically insulate the power layer 31, signal layer 33 and ground layer 35.

Figure 4:
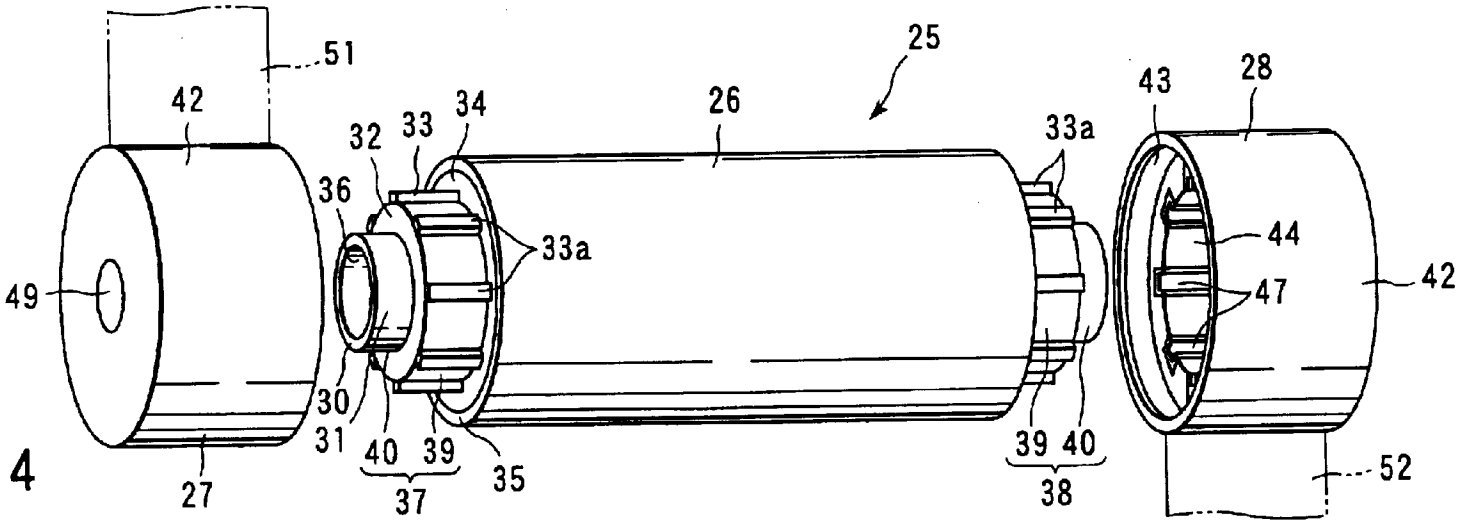
FIG. 4 is perspective view of the electrical connection apparatus according to the embodiment of the present invention, showing the positional relationship between a cylindrical wiring member, a first connector and a second connector.

The power layer 31, signal layer 33 and ground layer 35 are made of copper with excellent conductivity. The power layer 31 forms a power line to pass a current, and covers all over the outer circumference of the first dielectric layer 30. The signal layer 33 has a plurality of signal lines 33*a* to pass the signal to control the liquid crystal display device 11. As shown in FIG. 3 and FIG. 4, each signal line 33*a* has a linear conductor pattern extending in the axial direction of the wiring member 26. The conductor pattern width is 0.1 mm, for example. The signal lines 33*a* are located on the circumference C1 coaxial with the center axis 01 of the wiring member 26. Thus, the distance d1 from the center axis 01 of the wiring member 26 to each signal line 33*a* is equal. The signal lines 33*a* are arranged in the circumferential direction of the circumference C1 with a certain interval g. The interval g is 0.3 mm. The adjacent signal lines 33*a* are electrically insulated each other by the third dielectric layer 34. The third dielectric layer 34 fills the gap between the adjacent signal lines 33*a*. The ground layer 35 forms a ground line of the printed wiring board 7 and liquid crystal display device 11, and covers all over the outer circumference of the third dielectric layer 34.

In this embodiment, the second and third dielectric layers 32 and 34 have the same thickness. Thus, the power layer 31, signal layer 33 and ground layer 35 are laminated with equal intervals, so that the electric insulation among these layers 31, 33 and 35 becomes stable. In addition, the signal layer 33 is laminated inside of the wiring member 26 in the state interposed between the ground layer 35 and power layer 31. In other words, the ground layer 35 is exposed to the outer circumference of the wiring member 26, and covers the signal layer 33 from the outside along the radial direction of the wiring member 26. The power layer 31 covers the signal layer 33 from the inside along the radial direction of the wiring member 26. With this structure, the internal signal layer 33 of the wiring member 26 can be securely and electro-magnetically shielded, and the signal layer 33 is difficult to be influenced by induction noise from the outside of the wiring member 26.

The wiring member 26 has a first terminal 37 and a second terminal 38. The first terminal 37 is located at one end of the wiring member 26. The second terminal 38 is located at the other end of the wiring member 26, opposite to the first terminal 37. Since these first and second terminals 37 and 38 have the same structure, description will be given only of the first terminal 37.

As shown in FIG. 3 and FIG. 4, the first terminal 37 has a large diameter part 39 and a small diameter part 40. The large diameter part 39 is composed of the first dielectric layer 30, the second dielectric layer 32, the power layer 31 and the signal layer 33. The large diameter part 39 projects from the third dielectric layer 34 and the ground layer 35 in the axial direction of the wiring member 26. Thus, the signal line 33*a* of the signal layer 33 is exposed to the outer circumference of the large diameter part 39. The small diameter part 40 consists of the first dielectric layer 30 and the power layer 31. The small diameter part 40 is made coaxial with the large diameter part 39, and projects from the large diameter part 39 in the axial direction of the wiring member 26. Thus, the power layer 31 is exposed to the outer circumference of the small diameter part 40.

The wiring member 26 with this structure is fitted slidablly in the fitting hole 19 of the projection 17 of the housing 4. Thus, the ground layer 35 on the outer circumference of the wiring member 26 is electrically connected to the housing 4. At the same time, the first terminal 37 located at one end of the wiring member 26 and the second terminal part 38 located at the other end of the wiring member 26 project to the side of the projection 17.

The first connector 27 of the electric connection apparatus 25 is fitted removably in the first terminal part 37 of the wiring member 26. Similarly, the second connector 28 of the electric connection apparatus 25 is fitted removably in the second terminal 38 of the wiring member 26. Since the first and second connectors 27 and 28 have the same structure, description will be given only to the first connector 27.

Figure 7:
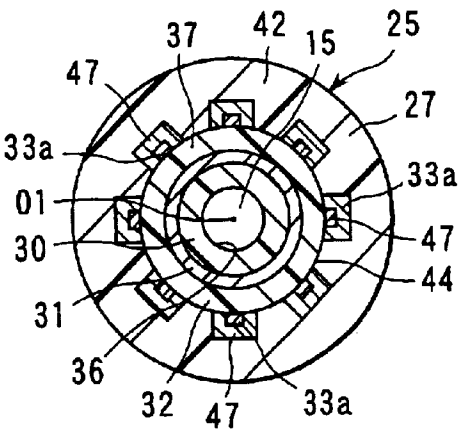
FIG. 7 is a sectional view cut along the F7—F7 line of FIG. 3.
Figure 6:
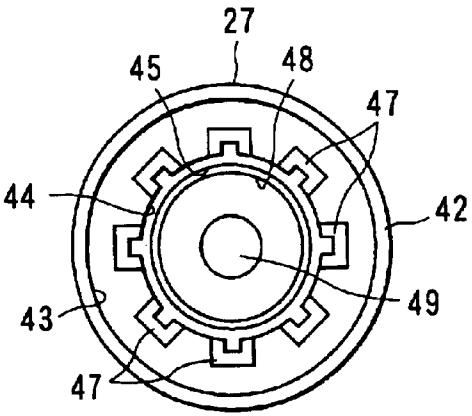
FIG. 6 is a front view of the first connector according to the embodiment of the present invention.
Figure 5:
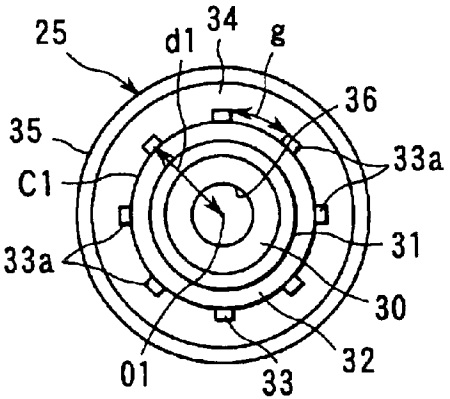
FIG. 5 is a front view of a wiring member according to the embodiment of the present invention.

As shown in FIG. 3 and FIG. 7, the first connector 27 has a cylindrical connector body 42. The connector body 42 is made of synthetic resin material having electric insulation characteristics, and covers the first terminal 37 from the outside. The connector body 42 has first to third recesses 43–45.

The first recess 43 fits with one end of the wiring member 26. In the inner circumference of the first recess 43, a cylindrical first contact piece 46 is supported. The first contact piece 46 contacts the ground layer 35 exposed to the outer circumference of the wiring member 26, and electrically connects the ground layer 35. The second recess 44 fits with the large diameter part 39 of the first terminal 37. The second recess 44 is located at the end of the first recess 43, and formed coaxially with the first recess 43. In the inner circumference of the second recess 44, a plurality of second contact pieces 47 are buried. The second contact pieces 47 are arranged in the circumferential direction of the second recess 44 with certain intervals, so as to correspond to the signal lines 33*a* of the signal layer 33. Each second contact piece 47 is formed like a groove to fit with the signal line 33*a* exposed to the outer circumference of the large diameter part 39. As shown in FIG. 7, the second contact pieces 47 engage with the signal lines 33*a*. By this engagement, the second contact pieces 47 are electrically connected to the signal lines 33*a*, and the relative rotation of the connector body 42 and first terminal 37 is prevented.

The third recess 45 fits with the small diameter part 40 of the first terminal 37. The third recess 45 is located at the end of the second recess 44, and is formed coaxially with the first and second recesses 43 and 44. In the inner circumference of the third recess 45, a third cylindrical contact piece 48 is fixed. The third contact piece 48 contacts the power layer 31 exposed to the outer circumference of the small diameter part 40, and electrically connects the power layer 31.

The connector body 42 has a bearing hole 49 at the end of the third recess 45. The bearing hole 49 is arranged coaxially with the first to third recesses 43–45. The hinge shaft 15 passes through the bearing hole 49. With this structure, the wiring member 26 and the first and second connectors 27 and 28 are supported rotatably about each other on the hinge shaft 15.

As shown in FIG. 2, the first connector 27 is interposed between the second bearing 21*a* of the display housing 12 and one end of the wiring member 26. The first to third contact pieces 46–48 of the first connector 27 are electrically connected to the liquid crystal drive circuit 11*b* of the liquid crystal display device 11 through a first flexible printed wiring board 51. The first flexible printed wiring board 51 is led from the first connector 27 into the display housing 12. The first flexible printed wiring board 51 has the length to absorb the movement of the display unit 3.

The second connector 28 is interposed between the second bearing 21*b* of the display housing 12 and the other end of the wiring member 26. The first to third contact pieces 46–48 of the second connector 28 are electrically connected to the printed circuit board 6 through a second flexible printed wiring board 52. The second flexible printed wiring board 52 is led from the second connector 28 into the housing 4. The second flexible printed wiring board 52 has the length to absorb the rotation of the second connector 28 even when the second connector 28 is rotated a little in the circumferential direction of the hinge shaft 15.

Next, description will be given on a method of manufacturing the wiring member 26 with reference to FIG. 8 to FIG. 14.

Figure 8:
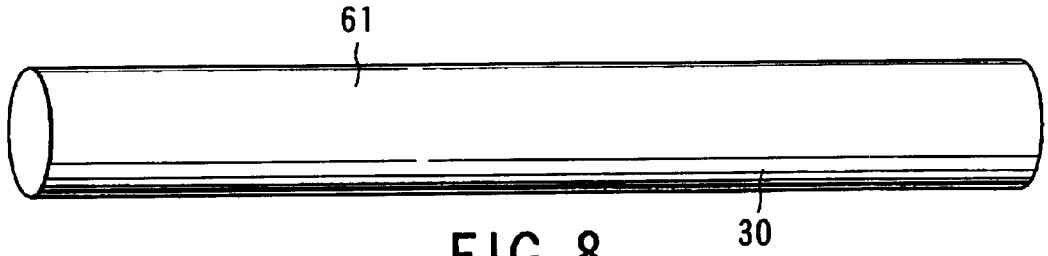
FIG. 8 is a perspective view of a core according to the embodiment of the present invention.
Figure 9:
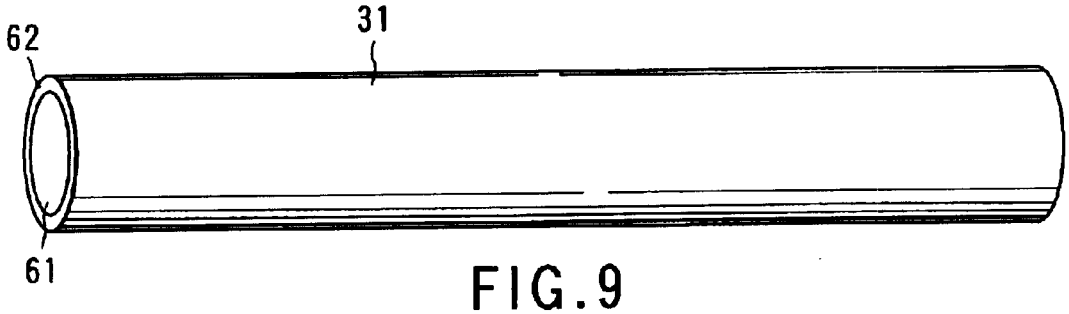
FIG. 9 is a perspective view showing a power layer formed on the outer circumference of the core, in the embodiment of the present invention.

First, prepare a cylindrical core 61, as shown in FIG. 8. The core 61 forms the first dielectric layer 30 of the wiring member 26, and is made of rigid synthetic resin material such as epoxy resin. Next, plate the outer circumference of the core 61 with copper. This forms a plated layer 62 on the outer circumference of the core 61, as shown in FIG. 9. The plated layer 62 forms the power layer 31 of the wiring member 26.

Figure 10:
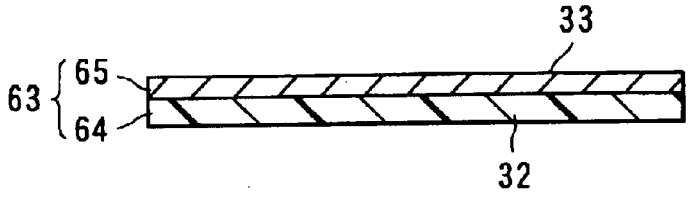
FIG. 10 is a cross sectional view of a first copper-clad laminate having a base substrate and a copper foil, in the embodiment of the present invention.
Figure 11:
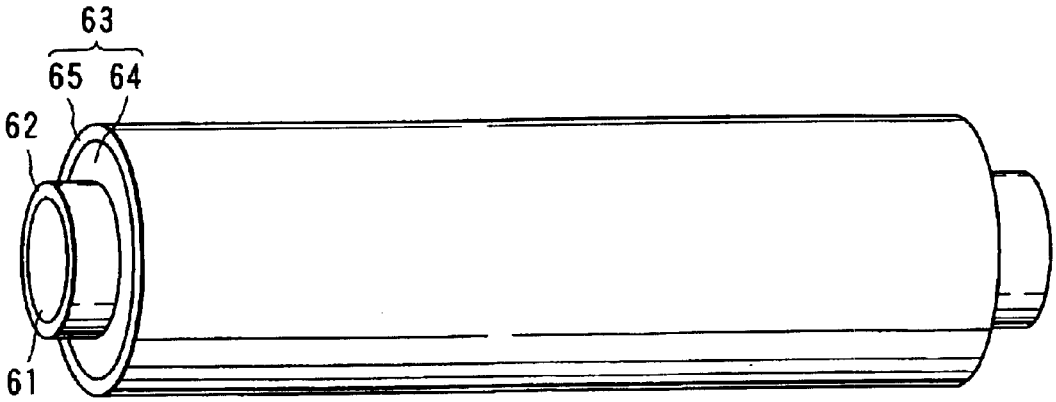
FIG. 11 is a perspective view showing the first copper-clad laminate wound around the power layer, in the embodiment of the present invention.

Next, prepare a first sheet copper-clad laminate 63 as shown in FIG. 10. The first copper-clad laminate 63 comprises a base substrate 64 and a copper foil 65 laminated on the base substrate 64. The base substrate 64 forms the second dielectric layer 32 of the wiring member 26, and is made of rigid synthetic resin material such as epoxy resin. The copper foil 65 forms the signal layer 33 of the wiring member 26. Then, while laying the base substrate 64 of the first copper-clad laminate 64 on the plated layer 62, wind the copper-clad laminate 64 around the core 61. This alternately laminates the base substrate 64 and copper foil 65 on the plated layer 62. Then, heat the copper-clad laminate 63, and press it down to the core 61. This completes bonding of the base substrate 64 to the plated layer 62.

Figure 12:
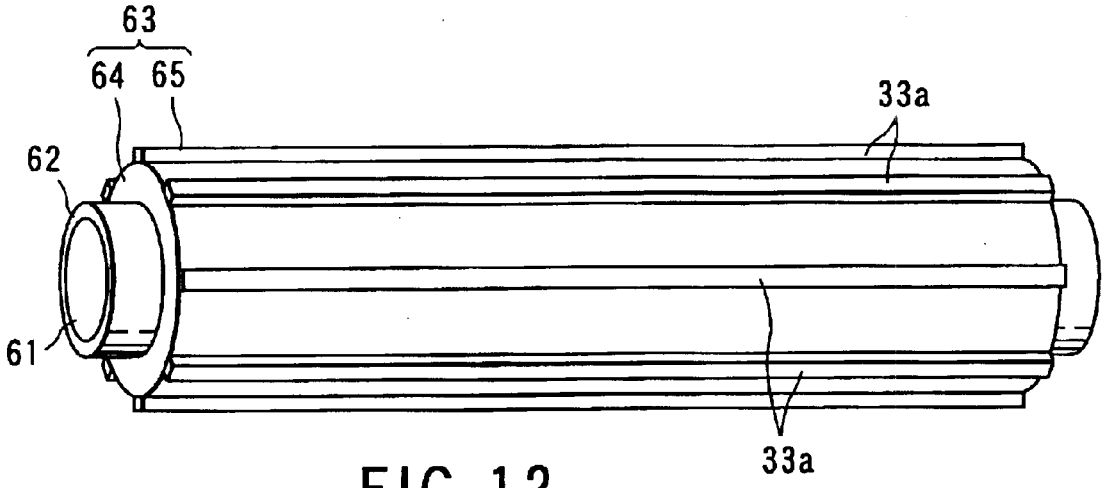
FIG. 12 is a perspective view showing a conductive pattern formed on the copper foil of the first copper-clad laminate, in the embodiment of the present invention.

Next, apply etching resist to the surface of the copper foil 65 by using a screen printing method, for example. Then, etch the copper foil 65, and form a plurality of signal lines 33*a* having a linear conductor pattern as shown in FIG. 12. Then, eliminate the etching resist, and expose the signal lines 33*a* to the second dielectric layer 32.

Figure 13:
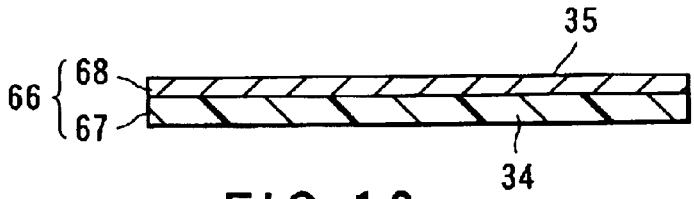
FIG. 13 is a cross sectional view of a second copper-clad laminate having a base substrate and a copper foil, in the embodiment of the present invention.
Figure 14:
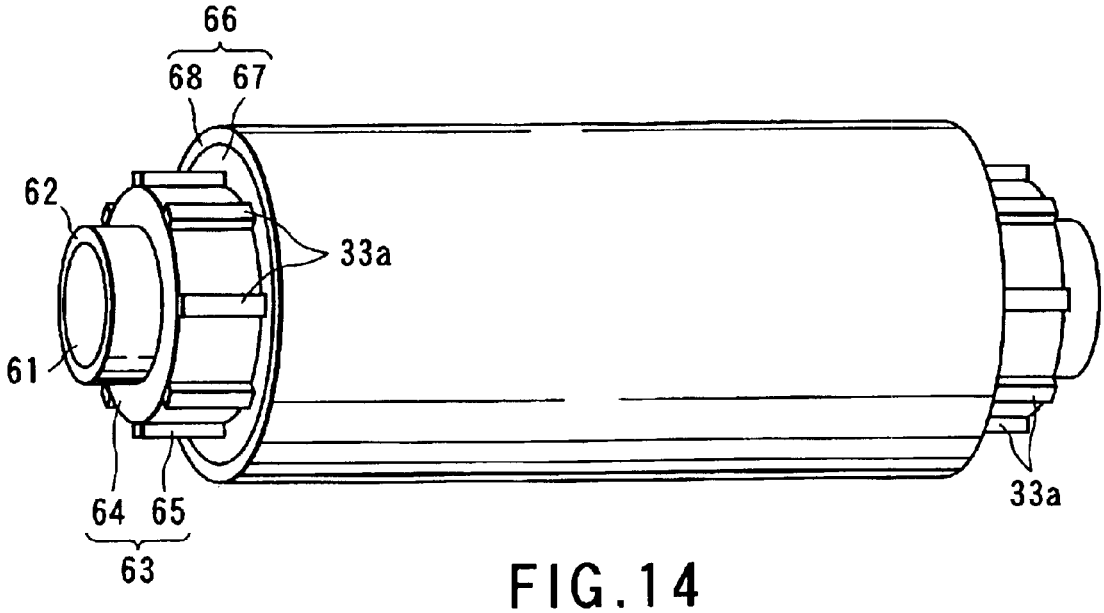
FIG. 14 is a perspective view showing the second copper-clad laminate wound around the copper foil of the first copper-clad laminate, in the embodiment of the present invention.

Next, prepare a second sheet copper-clad laminate 66 as shown in FIG. 13. The second copper-clad laminate 66 comprises a base substrate 67 and a copper foil 68 laminated on the base substrate 67. The base substrate 67 forms the third dielectric layer 34 of the wiring member 26, and is made of rigid synthetic resin material such as epoxy resin. The copper foil 68 forms the ground layer 35 of the wiring member 26. Then, while laying the base substrate 67 of the second copper-clad laminate 66 on the copper foil 65 of the first copper-clad laminate 63, wind the second copper-clad laminate 66 around the first copper-clad laminate 63. This alternately laminates the base substrate 67 and copper foil 68 on the copper foil 65. Then, heat the second copper-clad laminate 66, and press it down to the first copper-clad laminate 63. As a result, the base substrate 67 fuses and goes in between the signal lines 33*a*, and completes bonding of the base substrate 67 and signal lines 33*a* to the base substrate 64.

Finally, open the support hole 36 at the center of the core 61 by using a drill. This completes the process of manufacturing the wiring member 26.

By using the above-mentioned manufacturing method, it is possible to alternately laminate the first to third dielectric layers 30, 32, 34, power layer 31, signal layer 33 and ground layer 35 in the radial direction of the hinge shaft 15. Therefore, it is easy to obtain a multilayer cylindrical wiring member 26.

The support hole 36 through which the hinge shaft 15 passes is formed at the center of the core 61 after the first and second copper-clad laminates 63 and 66 are laminated on the core 61. In other words, the support hole 36 is formed at the center of the core 61 in the last step of the process of manufacturing the wiring member 26. Thus, when the first and second copper-clad laminates 63 and 66 are laminated on the core 61, the core 61 is not hollow. Therefore, the mechanical strength of the core 61 can be ensured, and the core 61 can be prevented from being deformed during the process of manufacturing the wiring member 26.

In the electric connection apparatus 25 with the above-mentioned structure, when the display unit 3 is turned up from the closed position to the opened position and vice versa, the hinge shaft 15 rotates following the display unit 3. The hinge shaft 15 passes through the support hole 36 in the wiring member 26 and the bearing hole 49 in the connector body 42. Thus, when the hinge shaft 15 rotates, the wiring member 26 and the first and second connectors 27 and 28 follow the hinge shaft 15, and tend to turn a little.

The wiring member 26 is constructed in one cylindrical unit by alternately laminating a dielectric layer and a conductor layer in the radial direction of the hinge shaft 15. Therefore, the power layer 31, signal layer 33 and ground layer 35 are held by the rigid dielectric layers 31, 33 and 35, and each layer is prevented from being deformed. Therefore, even when the wiring member 26 rotates, the power layer 31, signal layer 33 and ground layer 35 are prevented from being exposed to a severe bending or twisting force.

As a result, in each layer 31, 33 and 35, breaking of the wire is prevented, and the reliability of electrical connection between the printed circuit board 6 and liquid crystal display device 11 is ensured.

The first and second terminal units 37 and 38 of the wiring member 26 each have the large diameter part 39 and the small diameter part 40. The signal layer 33 of the wiring member 26 is exposed to the outer circumference of the large diameter part 39, while the power layer 31 is exposed to the outer circumference of the small diameter part 40. The first and second connectors 27 and 28 fitted in the first and second terminals 37 and 38 have the second and third recesses 44 and 45 corresponding to the large diameter part 39 and small diameter part 40, and the first and second contact pieces 47 and 48 arranged on the inner circumference of these recesses 44 and 45.

Thus, when the second and third recesses 44 and 45 are fitted in the large diameter part 39 and small diameter part 40, respectively, the signal layer 33 and power layer 31 contact the contact pieces 47 and 48. Therefore, it becomes easy to make mechanical coupling and electrical connection between the wiring member 26 and the first and second connectors 27 and 28, increasing the efficiency of assembling the electrical connection apparatus 25.

Further, with the wiring member 26 of the above-mentioned structure, the signal lines 33*a* of the signal layer 33 are located on the circumference C1 coaxial with the center shaft axis line 01 of the wiring member 26, and the distance d1 from the center axis 01 to each signal line 33*a* is equal. At the same time, the signal lines 33*a* are aligned with a certain interval g in the circumferential direction of the circumference C1. Therefore, the characteristic impedance of the wiring member 26 is stable, and the signal speed in each signal line 33*a* can be equalized.

The present invention is not to be limited to the above-mentioned embodiments, and may be embodied in other specific forms without departing from its spirit or essential characteristics. For example, it is possible to expose a power layer, a signal layer and a ground layer to the end face of a wiring member, and form a single recess to fit with the end of the wiring member in a connector body. In the end face of the recess, a plurality of contact pieces which contact the power layer, signal layer and ground layer, is arranged. Employing this structure, it is possible to simplify the structure of the coupling part to connect the wiring member and the first and second connectors.

Moreover, in the above-mentioned embodiments, the signal lines are engaged with the groove-like second contact pieces, thereby preventing the relative rotation of the wiring member and the first and second connectors. However, the present invention is not to be limited to this structure. For example, it is allowed to fix the connector body of the first and second connectors to the wiring member through a screw.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An electric connection apparatus comprising:

a center shaft;

a cylindrical main body through which the center shaft passes; the main body having a plurality of conductor layers, and rigid dielectric layers which electrically insulate the conductor layers; the conductor layers and the dielectric layers laminated alternately in the radial direction of the center shaft just like surrounding the center shaft;

a first terminal which is formed in the main body, and to which the conductor layers are exposed;

a second terminal which is formed in the main body, and to which the conductor layers are exposed; the second terminal located shifting in the axial direction of the main body with respect to the first terminal;

a first connector which is attached to the first terminal of the main body; the first connector having a plurality of contact parts electrically connected to the conductor layers; and a second connector which is attached to the second terminal of the main body; the second connector having a plurality of contact parts electrically connected to the conductor layers.

2. An electric connection apparatus according to claim 1, wherein the first terminal is located at one end of the main body, and the second terminal is located at the other end of the main body.

3. An electric connection apparatus according to claim 1, wherein the conductor layers includes a power layer, a signal layer and a ground layer; and the ground layer covers the outer circumference of the main body.

4. An electric connection apparatus according to claim 1, wherein the conductor layers includes a signal layer having a plurality of signal lines extending in the axial direction of the main body; the signal lines are located on the same circumference concentric with the center shaft, and are aligned with equal intervals in the circumferential direction of the main body.

5. An electric connection apparatus according to claim 3, wherein the signal layer is located between the ground layer and the power layer.

6. An electric connection apparatus according to claim 1, wherein the main body has a support hole through which the center shaft passes concentrically; and the first and second connectors have a bearing hole through which the center shaft passes concentrically.

7. An electric connection apparatus according to claim 1, wherein the first connector has a recess to fit with the first terminal; the second connector has a recess to fit with the second terminal; and contact parts of the first and second connectors are arranged inside of each recess.

8. An electric connection apparatus according to claim 1, further comprising first and second units which are connected rotatable to each other through the center shaft, the first unit having a first circuit module electrically connected to the second connector, and the second unit having a second circuit module electrically connected to the first connector.

9. An electric connection apparatus according to claim 8, further comprising:

a first flexible printed wiring board which electrically connects the first connector and the second circuit module; and a second flexible printed wiring board which electrically connects the second connector and the first circuit module.

10. An electric connection apparatus according to claim 8, wherein the first unit has a pair of bearings to support the center shaft; the bearings are separated from each other in the axial direction of the center shaft; and the main body, the first connector and the second connector are located between the bearings.

* * * * *